United States Patent [19]

Kawakami et al.

[11] Patent Number: 4,742,236

[45] Date of Patent: May 3, 1988

[54] FLAME DETECTOR FOR DETECTING PHASE DIFFERENCE IN TWO DIFFERENT WAVELENGTHS OF LIGHT

[75] Inventors: Yuichi Kawakami, Nishinomiya; Hakuzo Tani, Takatsuki, both of Japan

[73] Assignee: Minolta Camera Kabushiki Kaisha, Osaka, Japan

[21] Appl. No.: 856,668

[22] Filed: Apr. 25, 1986

[30] Foreign Application Priority Data

| | | | |
|---|---|---|---|
| Apr. 27, 1985 | [JP] | Japan | 60-91832 |
| Jul. 18, 1985 | [JP] | Japan | 60-156945 |
| Jul. 26, 1985 | [JP] | Japan | 60-164037 |
| Jul. 26, 1985 | [JP] | Japan | 60-164038 |
| Oct. 25, 1985 | [JP] | Japan | 60-237549 |
| Oct. 25, 1985 | [JP] | Japan | 60-237550 |

[51] Int. Cl.[4] ..... G08B 17/12

[52] U.S. Cl. ..... 250/554; 340/578

[58] Field of Search ..... 250/554, 226, 342, 372, 250/339, 228; 340/578

[56] References Cited

U.S. PATENT DOCUMENTS

| | | | |
|---|---|---|---|
| 3,665,440 | 5/1972 | McMenamin | 250/372 |
| 3,820,097 | 6/1974 | Larson | 340/578 |
| 3,940,753 | 2/1976 | Müller | 340/578 |
| 4,051,375 | 9/1977 | Schuetz et al. | 250/372 |
| 4,404,468 | 9/1983 | Kleinschmidt | 250/342 |
| 4,455,487 | 6/1984 | Wendt | 250/339 |
| 4,553,031 | 11/1985 | Cholin et al. | 250/339 |
| 4,603,255 | 7/1986 | Henry et al. | 250/339 |
| 4,630,684 | 12/1986 | Cinzori et al. | 340/578 |

FOREIGN PATENT DOCUMENTS

| | | |
|---|---|---|
| 45-22356 | 9/1970 | Japan . |
| 48-90030 | 11/1973 | Japan . |
| 49-128782 | 10/1974 | Japan . |
| 2020417A | 11/1979 | United Kingdom . |
| 2065880A | 2/1981 | United Kingdom . |

*Primary Examiner*—David C. Nelms
*Assistant Examiner*—William L. Oen
*Attorney, Agent, or Firm*—Price, Gess & Ubell

[57] ABSTRACT

A flame detector in which an infrared ray sensor having a specific infrared ray sensitivity and a visible ray sensor having a specific visible ray sensitivity are provided and output signals from both sensors are amplified by amplifiers, which in turn provide output signals to a phase discriminator circuit, the output signal from the amplifier for the infrared sensor output being also fed to a rectifier circuit for rectifying only a predetermined level or higher portion of the amplified output; an output signal from the rectifier circuit is fed to an integrator circuit and also fed to another integrator circuit through a switch which is opened when the output level of the phase discriminator circuit is "H"; then output signals from the integrator circuits are compared by a comparator and at the same time the output signal from said another integrator circuit is compared with a preset value by a comparator; and output signals from both comparators are fed to a control circuit which issues an alarm when the output levels of both comparators are "H".

29 Claims, 17 Drawing Sheets

FLAME DETECTOR FOR DETECTING PHASE DIFFERENCE IN TWO DIFFERENT WAVELENGTHS OF LIGHT

BACKGROUND OF THE INVENTION

1. Field of the Invention

The present invention relates to a flame detector which promptly detects a fire upon its occurrence whether outdoors or indoors. More particularly, it is concerned with a flame detector which detects a fire upon occurrence without being influenced by a strong interfering light such as sunlight or a reflected light from an object having high reflectance.

2. Description of the Prior Art

It has heretofore been known that the spectral emissivity of flame has a peak at the wavelength of 4.3 μm caused by $CO_2$ resonance radiation, as indicated by "a" in FIG. 1. Flame detection through detection of an infrared ray of this wavelength is advantageous for the following points: (1) Sensitivity to flame is high, (2) there does not occur an erroneous detection because an artificial light such as illumination light scarcely contains a component of wavelength 4.3 μm and (3) there is no erroneous detection caused by discharge sparks. In this connection, various flame detectors have already been proposed which detect the occurrence of flame through detection of a flare peculiar to flame in the range of wavelength 4.3 μm or thereabouts.

Even in such type of flame detectors, however, an erroneous detection sometimes occurs when the sunlight is directly incident on a light sensing portion of each detector or when the sunlight reflected on a high reflectance material such as metal is incident thereon, and thus there is a problem in their outdoor use.

As to the sunlight, its portion remaining after subtracting the portion absorbed in air from the black-body radiation energy of about 5700K° reaches the ground and provides a spectrum as indicated by "b" in FIG. 1. Here, the graphs "a" and "b" of FIG. 1 are normalized by each peak energies so it is impossible to make a direct comparison. In the sunlight spectrum, the intensity near the wavelength of 4.3 μm is fairly low as compared with the peak due to the absorption of $CO_2$. In view of this point there has been proposed a device in Japanese Patent Laid-Open Publication No. 128782/74 in which the detection of flame is performed using two wavelengths, one being a wavelength in the visible range wherein the radiation energy from flame is small and that from the sunlight is large, and the other being an infrared ray of wavelength 4.3 μm or thereabouts. However, under the intense sunlight during the summer season, there sometimes is observed a radiation intensity of about the same as that of flame even in the vicinity of wavelength 4.3 μm.

The device disclosed in the above laid-open publication No. 128782/74 is constructed so that a portion corresponding to a phase difference between an output signal of a first light sensing element having sensitivity to visible rays and an output signal of a second light sensing element having sensitivity to infrared rays is integrated and when the integrated value reaches a predetermined value, it is detected as a fire. However, in the case where the sunlight of high intensity is incident and is detected with only a slightly shifting of its phase from the phase of visible rays, flame occurrence is erroneously detected even if only interfering light is present. This inconvenience can be avoided by setting a high value to the predetermined judgment level for the integrated value, but this would result in deterioration of the actual fire detecting accuracy.

SUMMARY OF THE INVENTION

It is an object of the present invention to provide a flame detector capable of eliminating the above-mentioned drawbacks of the prior art and of accurately detecting only an actual occurrence of a fire.

It is another object of the present invention to provide a flame detector having a reduced possibility of an erroneous detection caused by an interfering light.

It is a further object of the present invention to provide a flame detector having an improved detection accuracy attained by the use of improved sensors.

Other objects and features of the present invention will become apparent from the following description taken in connection with the accompanying drawings.

DESCRIPTION OF PREFERRED EMBODIMENTS

Embodiments of the present invention will be described in detail hereinunder with reference to the accompanying drawings.

Figure 1:
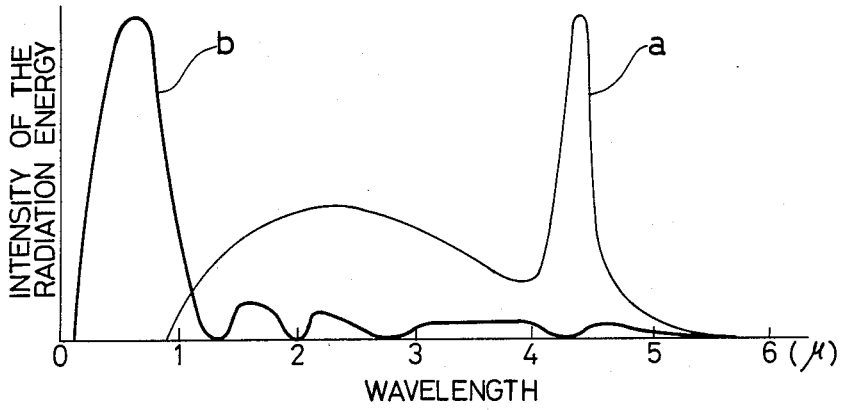
FIG. 1 is a diagram showing a spectrum of flame and that of sunlight.
Figure 2:
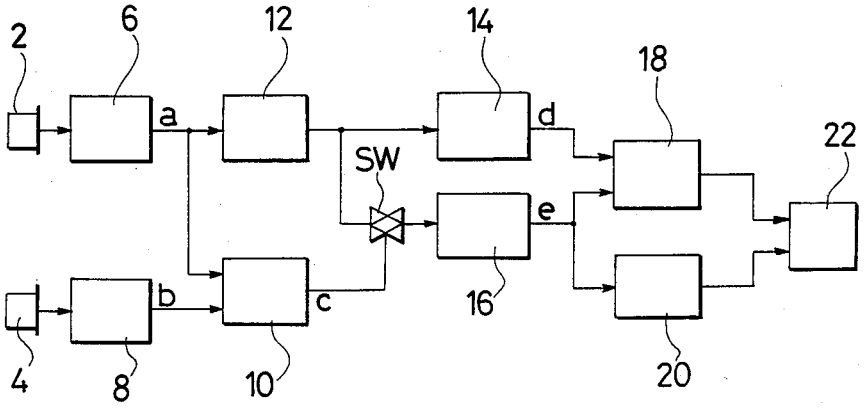
FIG. 2 is a circuit block diagram of a flame detector according to a first embodiment of the present invention.
Figure 2:
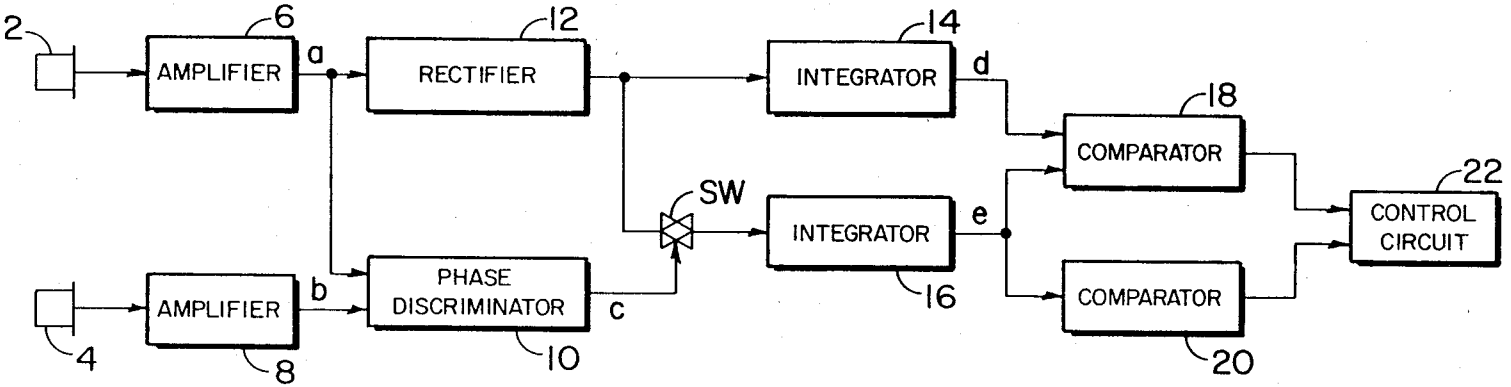
Figure 3:
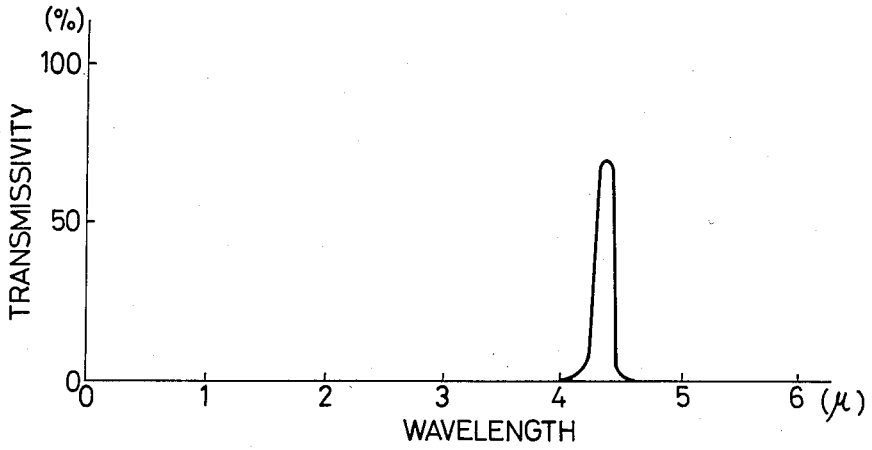
FIG. 3 is a diagram showing a spectral transmission characteristics of an infrared band pass filter.

In FIG. 2, which is a block diagram of a flame detector according to a first embodiment of the present invention, the reference numeral 2 denotes an infrared ray sensor having sensitivity to infrared rays of 4.3 μm or thereabouts in wavelength. For example, the infrared ray sensor 2 is constituted by a pyroelectric element such as a thermopile or a thermistor disposed to receive light which has passed through an infrared band pass filter having such a spectral transmission characteristic as shown in FIG. 3. Numeral 4 denotes a visible ray sensor having sensitivity to visible rays. The sensors 2 and 4 are disposed either in close proximity to each other or in positions conjugate with each other relative to an object to be detected.

Figure 4:
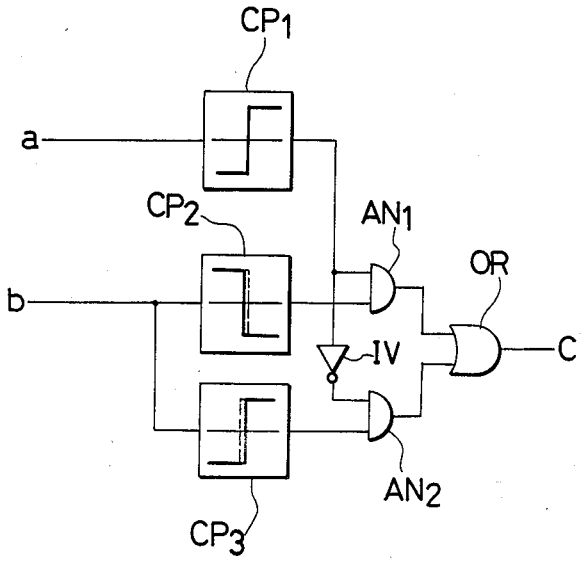
FIG. 4 is a block diagram of a phase discriminator circuit.

Numerals 6 and 8 denote amplifiers for amplifying output signals provided from the sensors 2 and 4. The amplifiers 6 and 8 each comprise a part for matching time constants of the sensors 2 and 4 and a part which selectively amplifies only a frequency component of 3–30 Hz of the output signals from both sensors which frequency component is peculiar to flame. Numeral 10 denotes a phase discriminator circuit which receives output signals from the amplifiers 6 and 8 and discriminates between phases of both output waveforms. For example, the phase discriminator circuit 10 is constructed as shown in FIG. 4. In FIG. 4, $CP_1$ denotes a comparator which outputs "H" when the output a of the amplifier 6 is positive and which outputs "L" when the said output a is negative; $CP_2$ denotes a comparator which outputs "L" when the output b of the amplifier 8 is positive or zero and which outputs "H" when the said output b is negative; and $CP_3$ denotes a comparator which outputs "H" when the output b of the amplifier 8 is positive and which outputs "L" when the said output b is negative or zero. Output signals from the comparators $C_{P1}$ and $CP_2$ are fed to an OR gate through an AND gate $An_1$. The output signal from the comparator $CP_1$ is also fed to an AND gate $AN_2$ through an inverter IV. On the other hand, an output signal from the comparator $CP_3$ is fed directly to the AND gate $AN_2$, which in turn provides an output signal to the gate OR.

Under such construction, an output c of the phase discriminator circuit 10 (i.e. an output c of the gate OR) becomes "H" when the output b is smaller than the output in the presence of flame alone and when the output b is larger than the output in the presence of flame alone but the signs of the outputs a and b are reverse to each other, and becomes "L" in other conditions. Thus, the judgment levels of the comparators $CP_2$ and $CP_3$ are somewhat offset to the positive or negative side according to the magnitude of the output b in the presence of flame alone as mentioned above.

Referring back to FIG. 2, numeral 32 denotes a full wave rectifier circuit which effects a full wave rectification for the output a of the amplifier 6 and which is so constructed as to effect a full wave rectification for only output signals a of levels higher than a predetermined level. In accordance with this predetermined level there is determined an infrared radiation value of flame to be detected. Numeral 14 denotes an integrator circuit for integrating output signals provided from the full waver rectifier circuit 12. The output of the circuit 12 is also fed for integration to an integrator circuit 16 through a switching element SW which is opened when the output c of the phase discriminator circuit 10 is "H". Numeral 18 denotes a comparator circuit for comparison between an output d of the integrator circuit 14 and an output e of the integrator circuit 16. The comparator circuit 18 outputs "H" when the output e is above a predetermined ratio of the output d. Numeral 20 denotes a comparator circuit for comparison between the output e of the integrator circuit 16 and a predetermined value. When the output e exceeds the predetermined value, the comparator circuit 20 outputs "H". Numeral 22 denotes a control circuit which issues an alarm only when the outputs of the comparator circuits 18 and 20 are both "H". Further, if the output of the comparator circuit 18 is "L" when the output of the comparator circuit 20 became "H", the control circuit 22 resets both integrator circuits 14 and 16. The integrator circuits 14 and 16 may be constructed so that their integrating operations are started simultaneously when the output level of the amplifier 6 exceeds a predetermined certain level, and if the results of integration do not exceed the predetermined level even after the lapse of a predetermined time, both integrator circuits 14 and 16 are reset.

Figure 5:
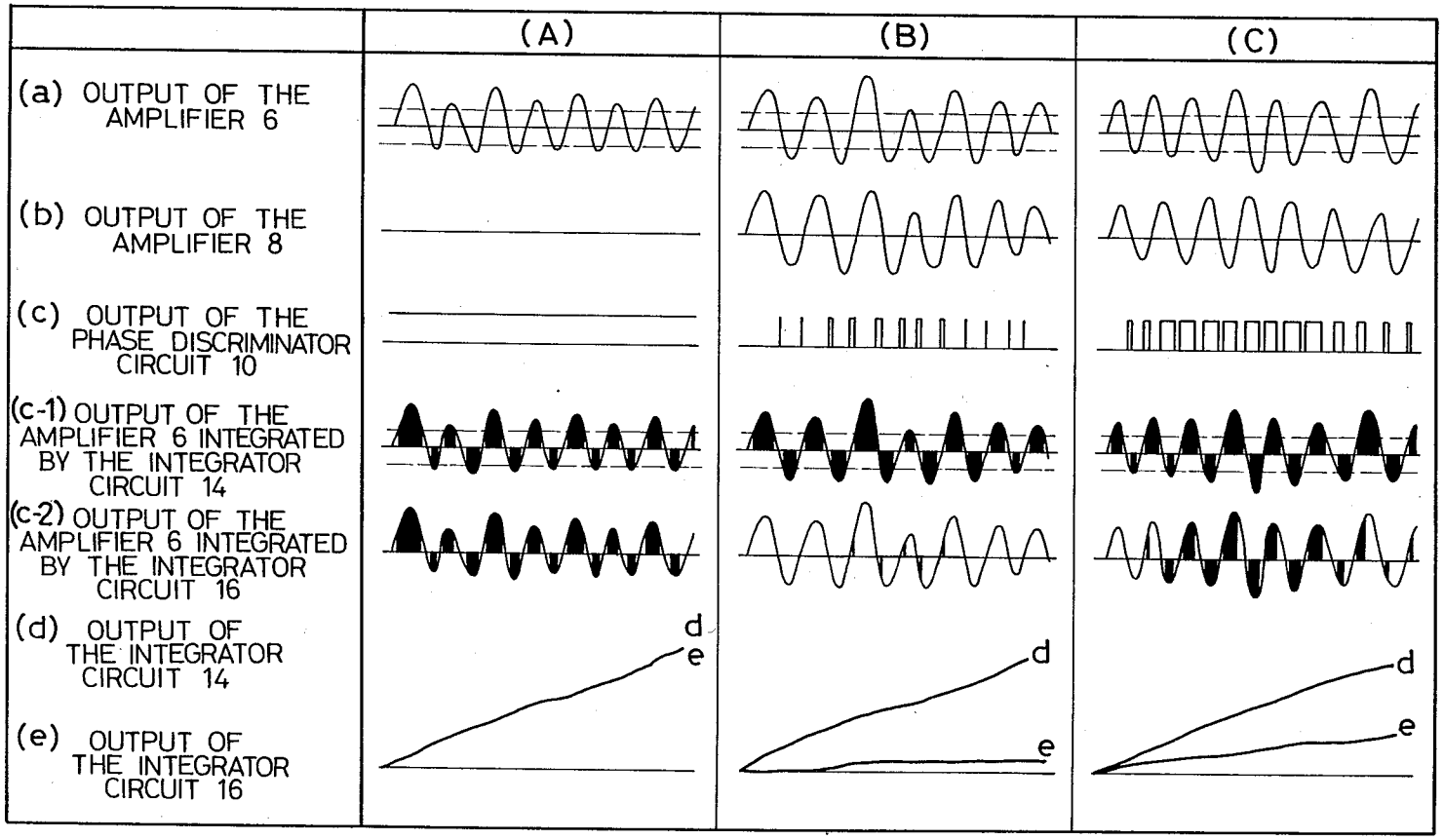
FIG. 5 is a time chart showing output waveforms of the portions indicated by reference numerals in the circuits of FIGS. 2 and 4.

The operation of the flame detector of this embodiment will now be described. Where only flame is present and there is little interfering light, the outputs a, b, c, d and e vary as shown in the time chart of FIG. 5(A). The output a of the amplifier 6 varies according to flaring of flame as shown in FIG. 5(A)-a, while the output b of the amplifier 8 is very small as shown in FIG. 5(A)-b because of a very small proportion of visible ray component contained in flame. Consequently, the output c of the phase discriminator circuit 10 remains "H" as shown in FIG. 5(A)-c, so that the switching element SW is kept open. Therefore, the output of the amplifier 6 integrated by the integrator circuit 14 corresponds to the area of black portions of the output a shown at C-1 in FIG. 5(A), while the output of the amplifier 6 integrated by the integrator circuit 16 corresponds to the area of black portions of the output a shown at C-2 in FIG. 5(A), both integrated values becoming equal to each other.

Consequently, the outputs d and e of both integrator circuits 14 and 16 become almost equal as shown in FIG. 5(A)-d and e, so that the output of the comparator circuit 18 becomes "H". When the output e of the integrator circuit 16 exceeds a value preset in the comparator circuit 20, the output of the comparator circuit 20 also becomes "H" and both inputs to the control circuit 22 become "H", so that the control circuit 20 issues an alarm and thus the occurrence of a fire is detected.

On the other hand, in the case where an interfering light alone is present, the outputs a–e vary as shown in FIG. 5(B). For example, where a reflected light of the sunlight is directly incident on the sensors 2 and 4 and undergoes a flaring having a frequency component similar to that of flame, the output a is of the same waveform as in the presence of flame according to the component of wavelength 4.3 μm contained in the sunlight energy. On the other hand, the output b of the amplifier 8 is of a waveform analogous to a according to a visible ray component contained in the sunlight. The amplitude ratio of both waveforms is the ratio of the visible ray component to the component of wavelength 4.3 μm both contained in the sunlight and it varies depending on the weather and characteristics of the object on which the light is reflected. Consequently, the output c of the phase discriminator circuit 10 is as shown in FIG. 5(B)-c, and since the switching element SW is opened only when this output c is "H", the output a of the amplifier 6 integrated by the integrator circuit 16 corresponds to only the area of black portions of the waveform of the output a shown at C-2 in FIG. 5(B).

Consequently, the output e of the integrator circuit 16 becomes extremely small as compared with the output d of the integrator circuit 14. Thus, when the output of the comparator circuit 20 is "H", the output d is extremely large as compared with the output e, so the output of the comparator circuit 18 is "L" and no alarm is issued from the control circuit 22. The occurrence of a deviation between the outputs a and b of the amplifiers 6 and 8 even in the presence of an interfering light alone is ascribable to a slight difference in time constant between the sensors 2 and 4 or a time lag of the interfering light incident on one of both sensors relative to that incident on the other.

Where both flame and interfering light are present, the outputs a–e vary as shown in FIG. 5(C). In this case, the output a of the amplifier 6 and the output b of the amplifier 8 are each independent in waveform. Consequently, the output c of the phase discriminator circuit 10 varies as shown in FIG. 5(C)-c and so the output a of the amplifier 6 integrated by the integrator circuit 16 corresponds to the area of black portions as shown at C-1 in FIG. 5(C), which area is larger than that in the presence of only interfering light shown in FIG. 5(B). Consequently, the output e of the integrator circuit 16 increases at a higher speed than in the case of FIG. 5(B), and when this output e exceeds the preset value in the comparator circuit 20, providing "H" output, the control circuit 22 issues an alarm because the output e is above the predetermined ratio of the output d and the output of the comparator circuit 18 is also "H".

Thus, according to this embodiment, an accurate detection of flame can be attained both in the presence of flame alone and in the presence of both flame and interfering light, and there will never be an erroneous detection under the presence of an interfering light alone, thus ensuring an extremely high accuracy. In this embodiment, however, where both flame and interfering light are present together, as compared with the presence of flame alone, the increase of output e is slow relative to d, thus requiring much time for the detection of flame, as is apparent from reference to d and e in FIGS. 5(A) and 5(C). An embodiment which remedies this drawback is illustrated in FIG. 6 and it will be described below.

Figure 6:
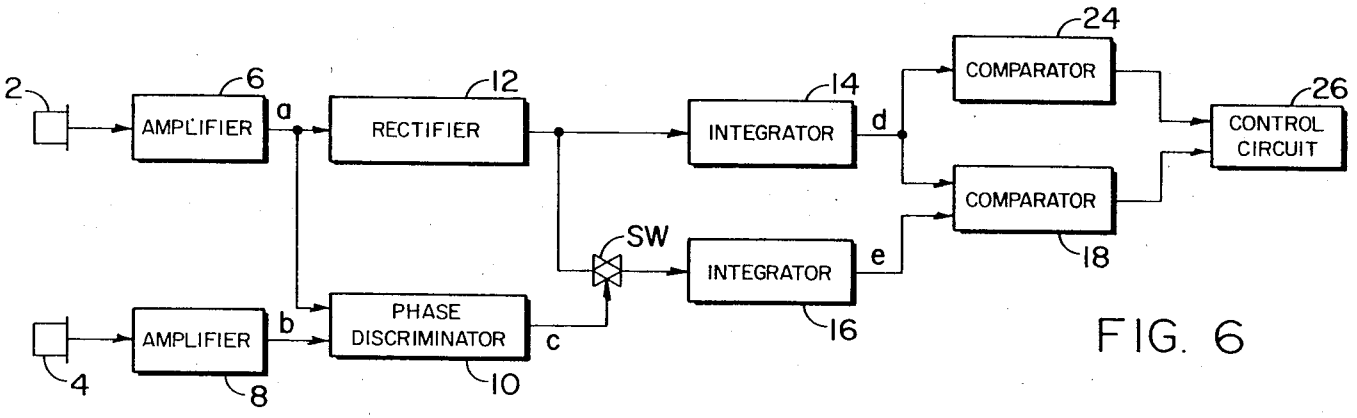
FIG. 6 is a circuit block diagram of a flame detector according to a second embodiment of the present invention.

FIG. 6 is a block diagram showing a second embodiment of the present invention, in which the components which function in the same manner as in the embodiment of FIG. 2 are indicated by the same reference numerals and explanations thereon will be omitted. In FIG. 6, a comparator circuit 18 which compares the outputs d and e of integrator circuits 14 and 16 with each other and outputs "H" when the output d is above a predetermined ratio of the output e, is of the same structure as the circuit 18 shown in FIG. 2. But in this embodiment, in place of the comparator circuit 20 which compares the output e with a preset value, there is provided a comparator circuit 24 which compares the output d with a preset value and outputs "H" when the output d exceeds the preset value. Further, a control circuit 26 detects a flame and issues an alarm when the output levels of the comparator circuits 18 and 24 both become "H".

In this second embodiment, the output of the comparator circuit 24 becomes "H" when the output d of the integrator circuit 14 exceeds a preset value. At this time, if the output e of the integrator circuit 16 is above a predetermined ratio of the output d, then the output level of the comparator circuit 18 is also "H", so an alarm is issued from the control circuit 26. Thus, according to this embodiment, the flame detection is not delayed even in the presence of an interfering light because when the output d has reached the preset value there is made a judgment as to whether the detection is of a flame or not, while according to the embodiment illustrated in FIG. 2 the flame detection is delayed because the increase of the output e is slower in the case of FIG. 5(C) where both flame and interfering light are present as compared with the case of FIG. 5(A) where flame alone is present.

Figure 7:
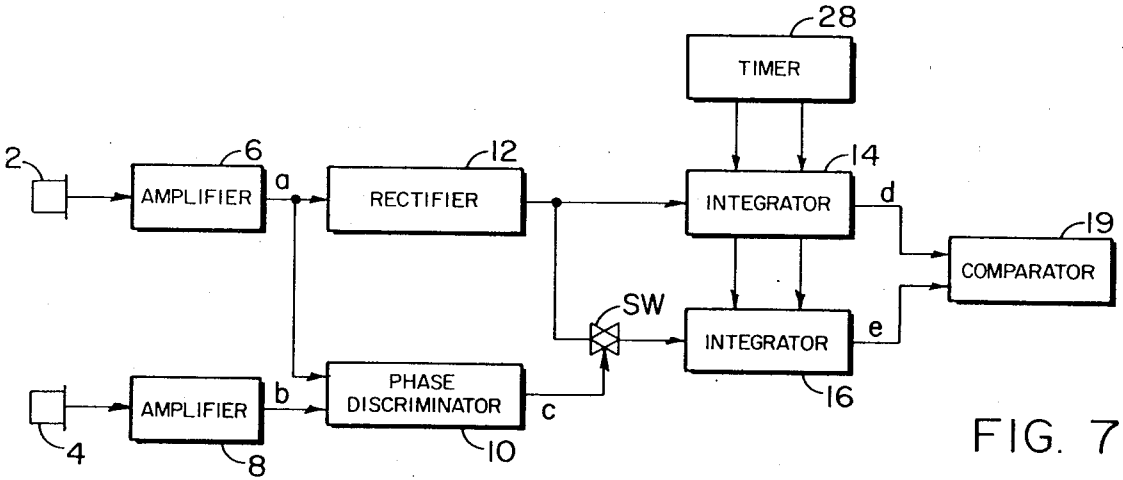
FIG. 7 is a circuit block diagram of a flame detector according to a third embodiment of the present invention.

FIG. 7 is a block diagram showing a third embodiment of the present invention, in which the reference numeral 28 denotes a timer circuit, and integrator circuits 14 and 16 are reset at every predetermined time tsec set in the timer circuit 28. Consequently, outputs d and e of both integrator circuits fed to a comparator circuit 19 are reset at every predetermined time $t_{sec}$. The comparator 19 calculates the ratio of d to e, and when this ratio exceeds a predetermined value, this condition is detected as a fire, whereupon an alarm is issued. A1so in this embodiment, the flame detection is not delayed in the coexistence of flame and interfering light as compared with the presence of only flame.

The following fourth embodiment realized a more accurate flame detection by detecting from incident light a frequency component of 3 to 30 Hz peculiar to flame in addition to the incident light detection in the above first to third embodiment.

Figure 8:
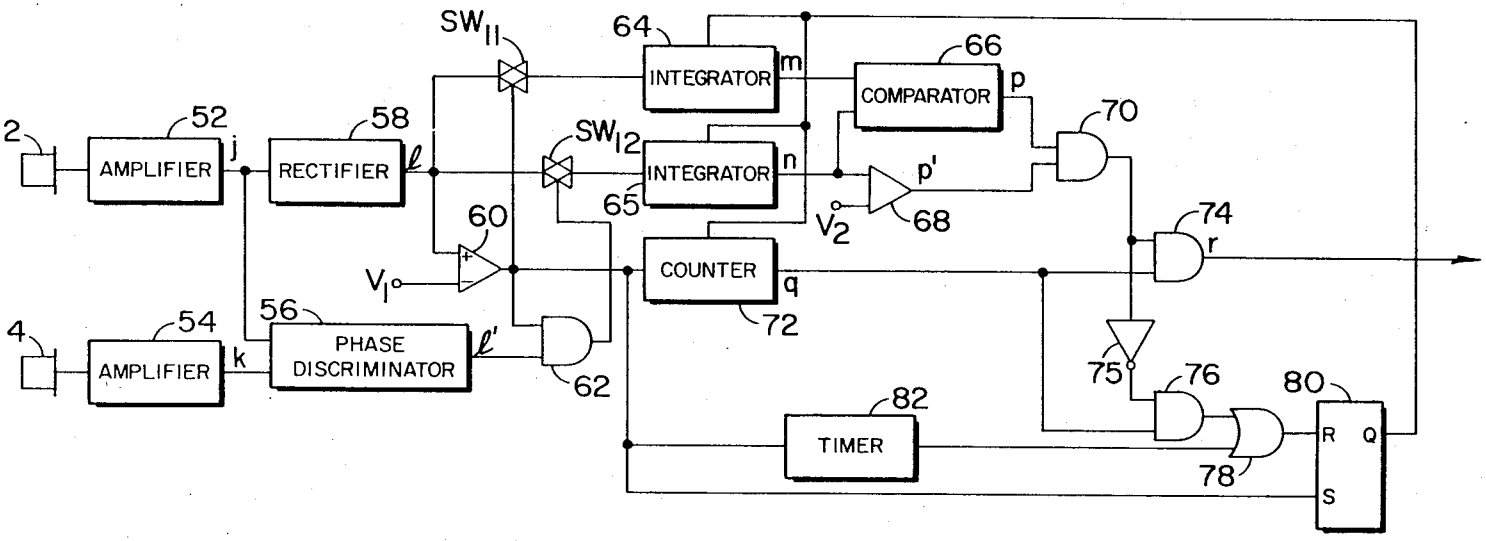
FIG. 8 is a circuit block diagram of a flame detector according to a fourth embodiment of the present invention.
Figure 8:
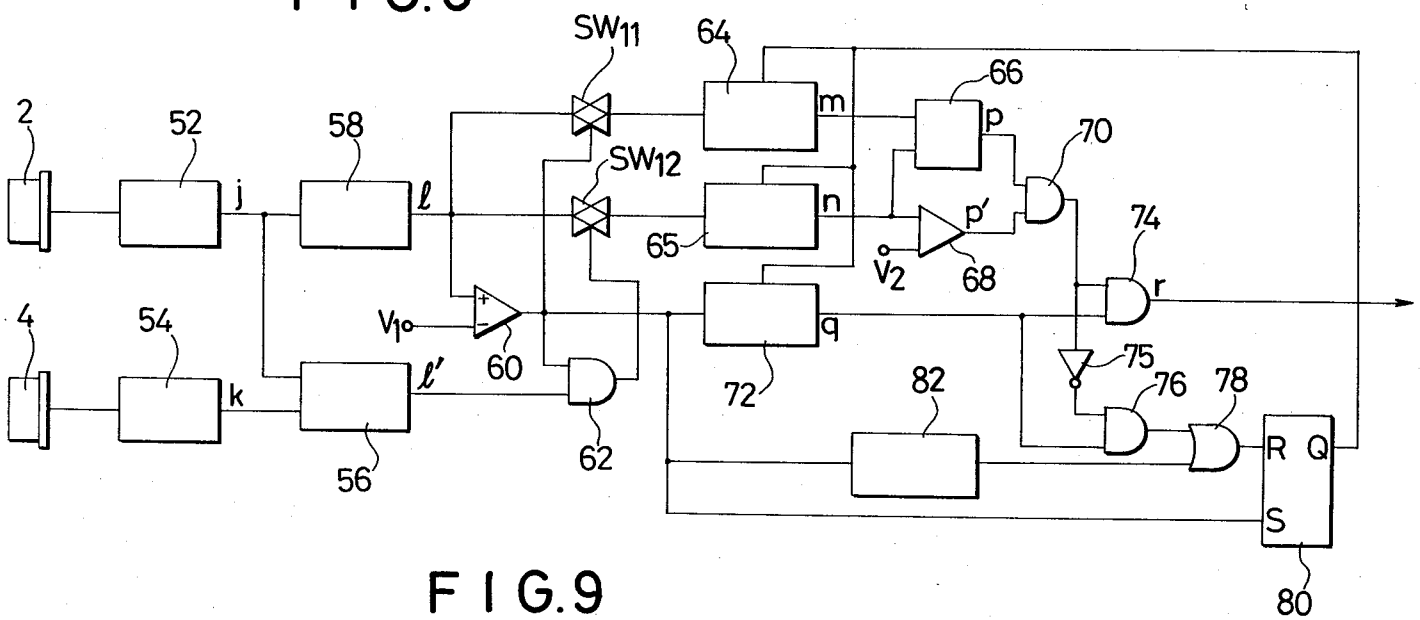

FIG. 8 is a block diagram illustrating a fourth embodiment of the present invention, in which the reference numeral 2 denotes an infrared ray sensor having sensitivity to infrared rays of wavelength 4.3 μm or thereabouts and numeral 4 denotes a visible ray sensor having sensitivity to visible rays. The sensors 2 and 4 are disposed in close proximity to each other or in positions conjugate with each other.

Numerals 52 and 54 denote amplifiers for amplifying output signals of the sensors 2 and 4, respectively. The amplifiers 52 and 54 are each composed of a part which matches time constants of the sensors 2 and 4 and a part which selectively amplifies only a frequency component of 3 to 30 Hz of those output signals which frequency component is peculiar to flame. Numeral 56 denotes a phase discriminator circuit which receives output signals from both amplifiers 52 and 54 and which compares the phases of both output waveforms. The phase discriminator 56 is of the same construction as the phase discriminator circuit 10 used in the first embodiment.

Figure 9:
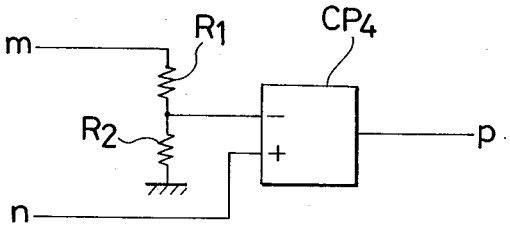
FIG. 9 is a block diagram of a comparator circuit.

Numeral 58 denotes a full wave rectifier circuit which effects a full wave rectification for an output j of the amplifier 52 and numeral 60 denotes a comparator which compares an output signal provided from the full wave rectifier circuit with a predetermined reference level $V_1$ and provides an output signal of "H" level when the former exceeds the latter. In accordance with this predetermined reference level an infrared radiation value of flame to be detected is determined. Numeral 64 denotes an integrator circuit which receives and integrates an output l of the full wave rectifier circuit 58 through a switching element $SW_{11}$ which is opened when the output level of the comparator 60 is "H". Numeral 62 denotes an AND gate which receives output signals from the comparator 60 and phase discriminator circuit 56. Numeral 65 denotes an integrator circuit which receives and integrates an output signal from the full wave rectifier circuit 58 through a switching element $SW_{12}$ which is opened when the output level of the AND gate 62 is "H". Numeral 66 denotes a comparator circuit which compares an output m of the integrator circuit 64 with an output n of the integrator circuit 65 and provides an output signal of "H" level if the output n is exceeded a predetermined ratio of the output m. The detail of the circuit is as shown in FIG. 9 in which an input voltage m is divided at a predetermined ratio by means of resistors $R_1$ and $R_2$, then the divided voltage is compared with an input voltage n in a comparator $CP_4$.

Numeral 68 denotes a comparator circuit which compares the output n of the integrator circuit 65 with a preset value $V_2$ and which provides an output signal of "H" level when the output n exceeds the preset value $V_2$. Numeral 70 denotes an AND gate which provides an output signal of "H" level only when outputs p and p' of the comparator circuits 66 and 68 respectively are both "H". Numeral 72 denotes a counter which counts the number of positive edges of an output of the comparator 60 and provides "H" when the number of such positive edges exceeds a predetermined number. Numeral 74 denotes an AND gate which provides an alarm output r when outputs of the AND gate 70 and counter 72 are both "H". Numeral 76 also denotes an AND gate which receives the output q of the counter 72 and also receives the output of the AND gate 70 through an inverter 75. Numeral 82 denotes a timer which is so constructed as to be set with a positive edge of the output of the comparator 60 and provides an output signal of "H" level after the lapse of a predetermined time. Alternatively, the timer 82 may be so constructed as to be set with a negative edge of the output from the comparator 60 and provide "H" after the lapse of a predetermined time. Numeral 78 denotes an OR gate which resets a flip flop 80 when the output level of the AND gate 76 or the timer 82 becomes "H". The flip flop 80 is to control the integrator circuits 64, 65 and the counter 72, and it is set with an output signal from the comparator 60 and reset with an output signal from the OR gate 78. Its output terminal is connected to the integrator circuits 64, 65 and the counter 72 to operate the integrator circuits and the counter when its output is "H" and reset these circuits when its output is "L".

Figure 10:
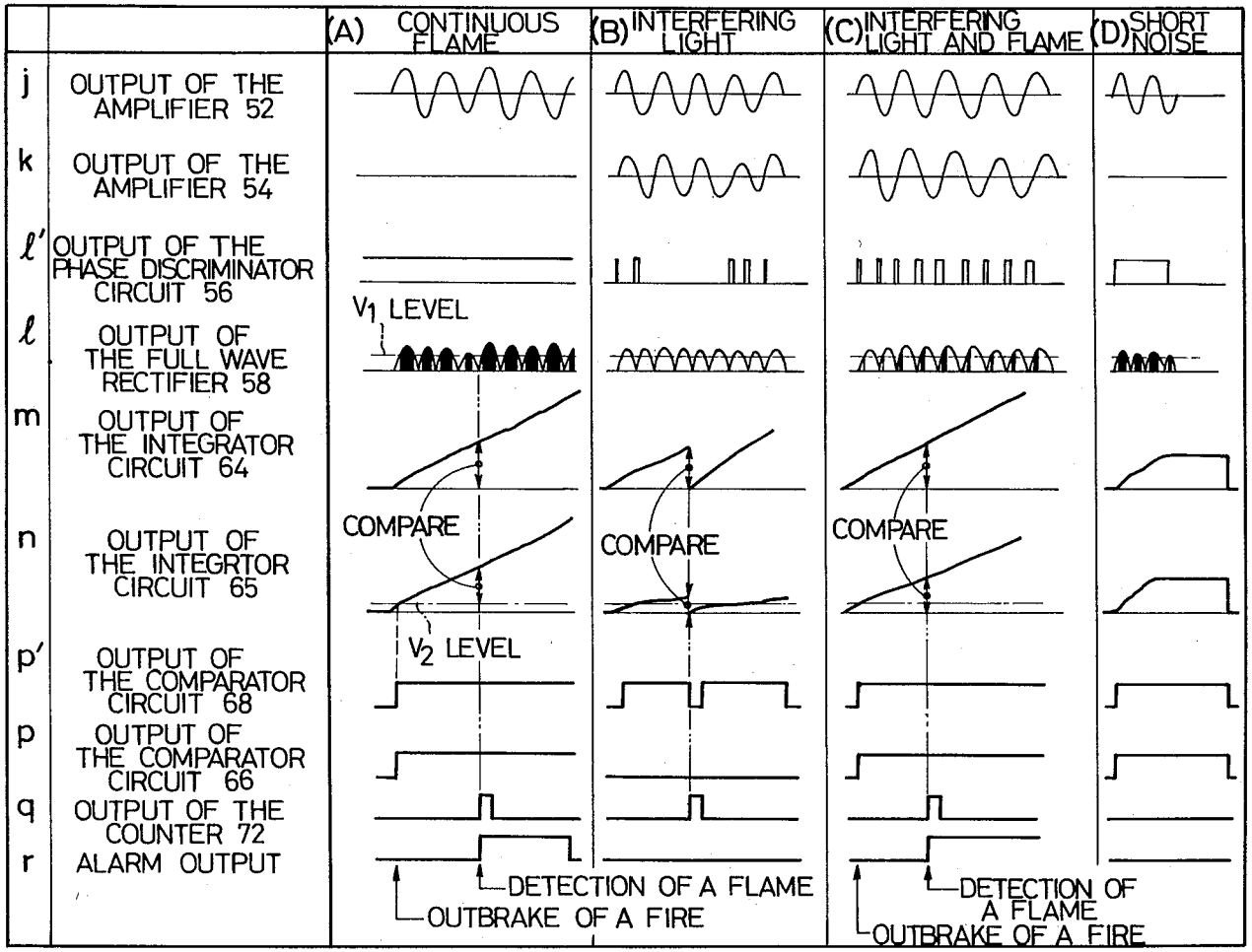
FIG. 10 is a time chart showing output waveforms of the portions indicated by reference numerals in the circuit of FIG. 8.

The operation of this embodiment will now be described. FIGS. 10-*j* and *k* show waveforms of output signals provided from the infrared ray sensor 2 and visible ray sensor 4 through amplification in the amplifiers 52 and 54 in the cases of a continuous flame (A), interfering light (B) and both interfering light and flame (C). All these three cases are similar in output waveform l resulting from rectification of the output of the infrared ray sensor in the full wave rectifier circuit 58. The output signal l of the full wave rectifier circuit 58 is compared with a predetermined reference level $V_1$ in the comparator 60 and the number of positive edges provided when the output level of the signal l exceeds $V_1$ is counted by the counter 72, which in turn provides a rise signal of "H" level to the AND gate 74 when the count value exceeds a preset value. FIG. 10-*q* shows output waveforms of the counter 72.

Where flame alone is present and there scarcely is present an interfering light, the output j of the amplifier 52 varies according to flaring of flame as shown in FIG. 10(A), while the output k of the amplifier 54 is very small as shown in the same figure because of an extremely reduced visible ray component in the flame. Consequently, an output l' of the phase discriminator circuit 56 remains "H" as shown in FIG. 10(A). The output of the amplifier 58 integrated by the integrator circuit 64 corresponds to the area of black portions of the full wave rectifier output l shown in FIG. 10(A) and the output of the amplifier 58 integrated by the integrator circuit 65 also corresponds to the area of black portions of the full wave rectifier output l shown in the same figure, both integral values becoming equal to each other.

Consequently, the outputs m and n of the integrator circuits 64 and 65 become almost the same as shown in FIG. 10(A) and hence the output p of the comparator circuit 66 becomes "H".

Explanation will now be given with reference to FIG. 10(B) about the case where an interfering light alone is present. For example, where a reflected light of the sunlight is directly incident on the sensors 2 and 4 and undergoes a flaring having the same frequency component as flame, the output l of the amplifier 52 comes to have a waveform similar to that observed in the presence of flame, according to an infrared ray component of wavelength 4.3 $\mu$m contained in the sunlight. On the other hand, the output k of the amplifier 54 comes to have a waveform analogous to j according to a visible ray component contained in the sunlight. In this case, the amplitude ratio of both waveforms corresponds to the ratio of the visible ray component to the component of wavelength 4.3 $\mu$m both contained in the sunlight and it varies depending on the weather and characteristics of an object on which the sunlight is reflected. Therefore, the output l' of the phase discriminator circuit 56 has such a waveform as shown in FIG. 10(B) and since the switch $SW_{12}$ becomes open only when this output l' is "H", the output j of the amplifier 52 integrated by the integrator circuit 65 corresponds to only the area of black portions of the waveform of the full wave rectifier output l shown in FIG. 10(B).

Consequently, the output n of the integrator circuit 65 becomes extremely small as compared with the output m of the integrator circuit 64 and so it remains "L". The occurrence of a deviation between the outputs j and k even in the presence of an interfering light alone is ascribable to slight difference in time constant between the sensors 2 and 4 or a time lag of an interfering light incident on one sensor relative to that incident on the other.

Explanation will now be given with reference to FIG. 10(C) about the case where both flame and interfering light are present. The output j of the amplifier 52 and the output k of the amplifier 54 are independent in waveform. Consequently, the output l' of the phase discriminator circuit 56 varies as shown in FIG. 10(C)

and hence the output l of the amplifier 52 integrated by the integrator circuit 65 corresponds to the area of black portions in FIG. 10(C), which area is larger than that in the presence of only interfering light shown in FIG. 10(B). Therefore, the output n of the integrator circuit 65 increases at a speed higher than that in FIG. 10(B), and the value of n is exceeds the predetermined ratio $(R_1/(R_1+R_2)$; see FIG. 9)of the output m of the integrator circuit 64, and the output of the comparator circuit 66 also becomes "H".

When the output n of the integrator circuit 65 exceeds the preset value $V_2$ in the comparator circuit 68, the output p' of the comparator circuit 68 becomes "H".

An alarm output r shown in FIG. 10(C) becomes "H" when p, p' and q are all "H" through the AND gates 70 and 74. In other words, the alarm output r is provided when the output q of the counter 72 has become "H" and when the outputs p and p' of the integral value comparator circuits 66 and 68 are both "H".

Further, when the output q of the counter 72 has become "H", if either the output p of the comparator circuit 66 or the output p' of the comparator circuit 68 is "L", the output of the AND gate 76 becomes "H" to reset the flip flop 80 through the OR gate 78, whereupon the integrator circuits 64, 65 and the counter 72 are reset with an output signal provided from the flip flop 80 and revert to the respective initial states.

Thus, in the incidence of an interfering light, the integrator circuits 64, 65 and the counter 72 are reset just after judging that the incident light is an interfering light, so a flame can be detected exactly even if a fire breaks out just after incidence of the interfering light.

Explanation will now be given with reference to FIG. 10(D) about the case where a short noise is incorporated in the output of the infrared ray sensor 2. In this case there appears only the output signal j of the output amplifier 52 for the infrared ray sensor, so that output l' of the phase discriminator circuit 56 becomes "H" as shown in FIG. 10(D). Consequently, the output j of the amplifier 52 integrated by the integrator circuits 64 and 65 corresponds to the area of black portions of the output l of the full wave rectifier circuit 58 shown in FIG. 10(D) and the integral values of both integrator circuits 64 and 65 become equal to each other, so that the outputs m and n of those integrator circuits become almost the same as shown in FIG. 10(D) and hence the output p of the comparator circuit 66 becomes "H". In this case, since the noise incident on the sensor is not a continuous noise, a predetermined number of signals are not fed to the counter 72 which counts the number of positive edges of pulse from the full wave rectifier circuit 58 in the condition the output l of the full wave rectifier circuit 58 exceeds the reference level $V_1$, so that the output of the counter 72 does not become "H", providing no signal to the AND gate 76 even upon occurrence of noise, and hence no alarm output is provided. Then, upon lapse of a preset time in the timer 82 which has been set and started by the output of the comparator 60, the output level of the timer 82 becomes "H" to reset the flip flop 80 through the OR gate 78, whereby the integrator circuits 64, 65 and the counter 72 are reset and revert to the respective initial states.

In this embodiment, as set forth above, even in the case of an infrared ray of wavelength 4.3 μm contained as a strong interfering light in the sunlight, it is possible to eliminate the possibility of detecting it as flame erroneously, and also against a short noise sensed by the infrared ray sensor, there is no possibility of judging it as noise and issuing an erroneous alarm. Further, since the detection circuits are reset at every preset time, it is possible to effect flame detection immediately even in the event of occurrence of a flame just after incidence of an interfering light or noise. Thus it is possible to provide a flame detector of a high reliability not influenced by a disturbance such as an interfering light or noise and capable of detecting a flame without fail.

The following description is now provided about sensors used in the flame detector of the present invention.

In the flame detector of the present invention there are detected two kinds of light rays, one being in a wavelength range small in the radiation energy from a flame and large in the radiation energy from the sunlight and the other in a wavelength range small in the radiation energy from the sunlight and large in the radiation energy from a flame, and on the basis of a phase shift between the detected signals there is made a judgment as to whether a flame is present or not. Therefore, it is essential that the above two kinds of light rays be incident on the detector simultaneously.

If an incident interfering light is not in the form of a beam like a heat source, it is possible to let the interfering light be incident on both sensors simultaneously by disposing the sensors in close proximity to each other. But in the case where the sunlight is reflected by a vibrating object and then incident on the sensors, that is, in the case of a beam-like interfering light, there is the possibility of such interfering light being not incident on both sensors even if the sensors are disposed close to each other and hence the possibility of an erroneous detection.

The present invention provide an original idea about the arrangement of sensors. Examples of sensors will be described below.

Figure 11:
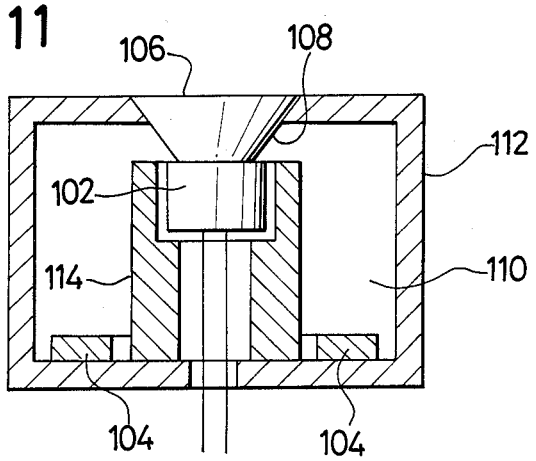
FIG. 11 is a sectional view showing a first example of sensors used in the invention.

FIG. 11 is a sectional view of a first example of sensors, in which numeral 112 denotes a cylindrical light shielding member having a light incident portion 106 formed in a central part of its upper surface. Numeral 102 denotes an infrared ray sensor having a sharp sensitivity to a wavelength of 4.3 μm, the infrared ray sensor 102 being disposed just under the light incident portion 106. A conical light diffusing plate 108 is disposed between the light incident portion 106 and the infrared ray sensor 102. Numeral 104 denotes a visible ray sensor disposed annularly on the bottom of the cylindrical light shielding portion 112. In order to minimize the unevenness in sensitivity, it is desirable to use a plurality of elements and take the sum of output signals thereof. Numeral 114 denotes a heat insulating member for shielding light and for thermally insulating and protecting the infrared ray sensor 102. Numeral 110 represents a space formed by an inner wall of the light shielding member 112 and an outer wall of the heat insulating member 114. The space 110 corresponds to an integral portion for further diffusing an incident light which has passed through the light diffusing plate 108 and conducting it to the visible ray sensor.

Under the above construction, light from an area to be detected is incident on and detected by the infrared ray sensor 102 and the visible ray sensor 104 over a wide range of incident angle. The light incident on the annular visible ray sensor 104 is fully diffused by the diffusing plate 108 and the integral portion 110, and since the visible ray sensor 104 is constituted by plural elements, it is possible to minimize the unevenness in sensitivity based on the magnitude of incident angle and the direction of incidence.

The operation of those sensors will be explained below with reference to FIGS. 12 and 13.

Figure 12:
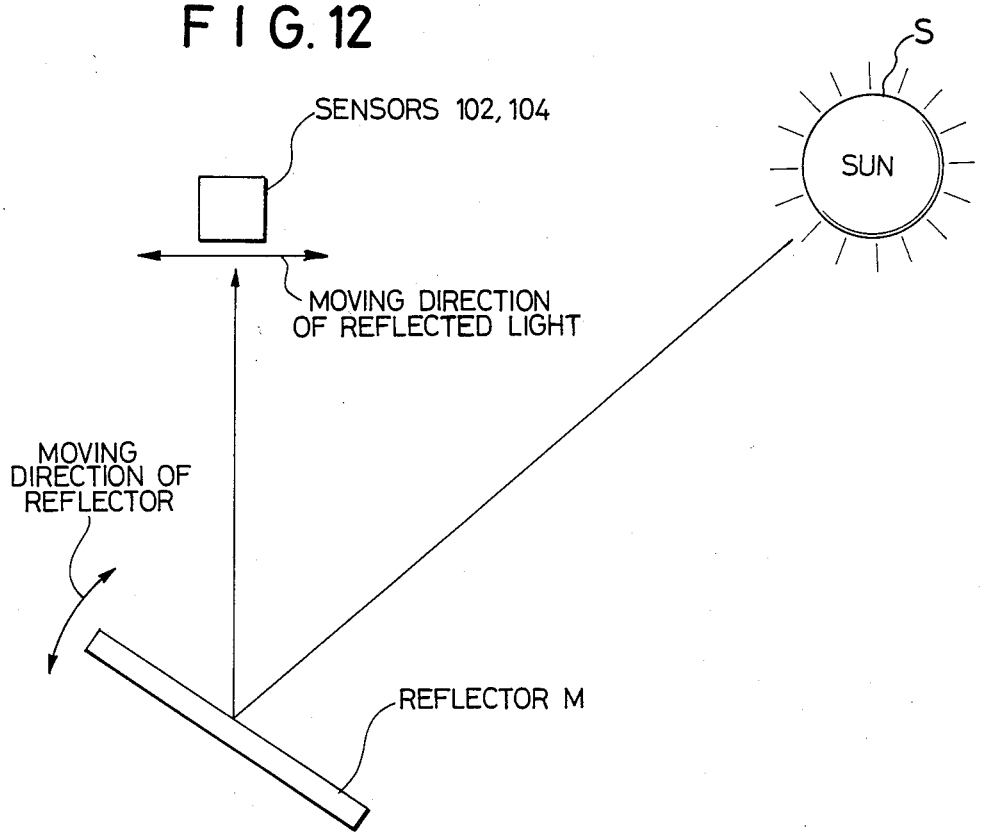
FIG. 12 is an explanatory view in which the sunlight is reflected by a vibrating reflector and is then incident on the sensors.

In FIG. 12, light from the sun S is reflected by a reflector M and incident on the sensors 102 and 104. In this case, if the reflector M vibrates as indicated by arrows, the reflected light incident on the sensors also vibrates in the same direction.

Figure 13:
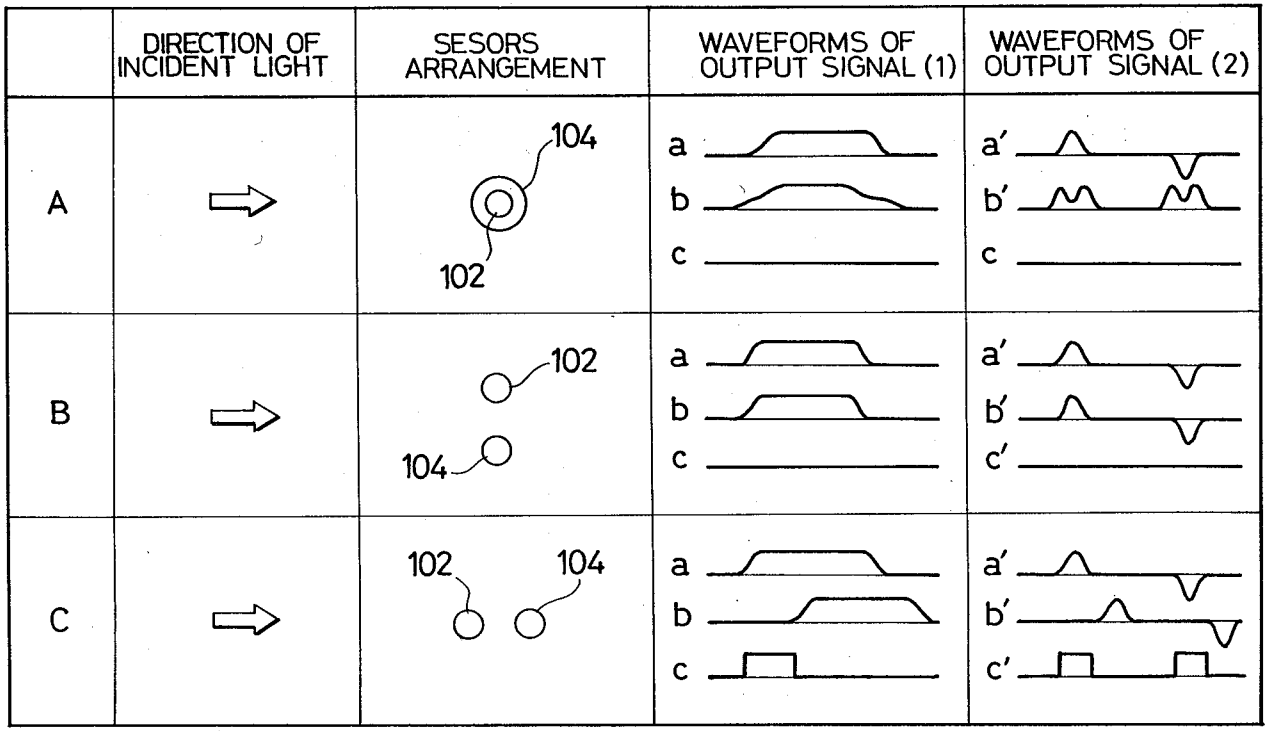
FIG. 13 is a diagram showing waveforms of output electric signals which differ depending on the direction of incident light and arrangement of the sensors.
Figure 14:
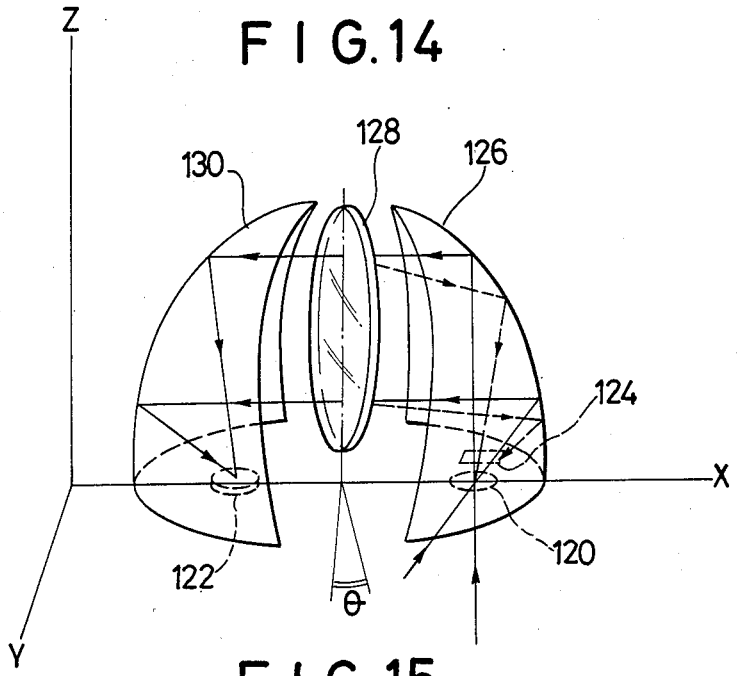
FIG. 14 is a constructional perspective view showing a second example of sensors in the invention.
Figure 15:
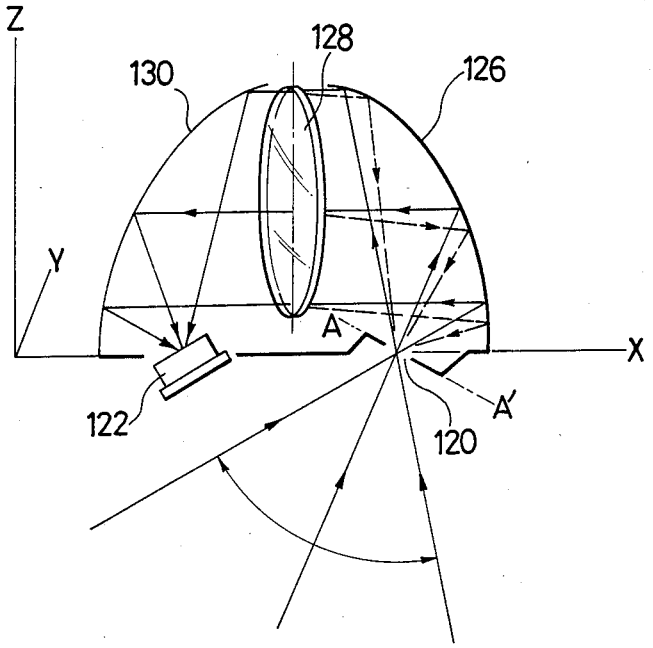
FIG. 15 is a sectional side view thereof.
Figure 16:
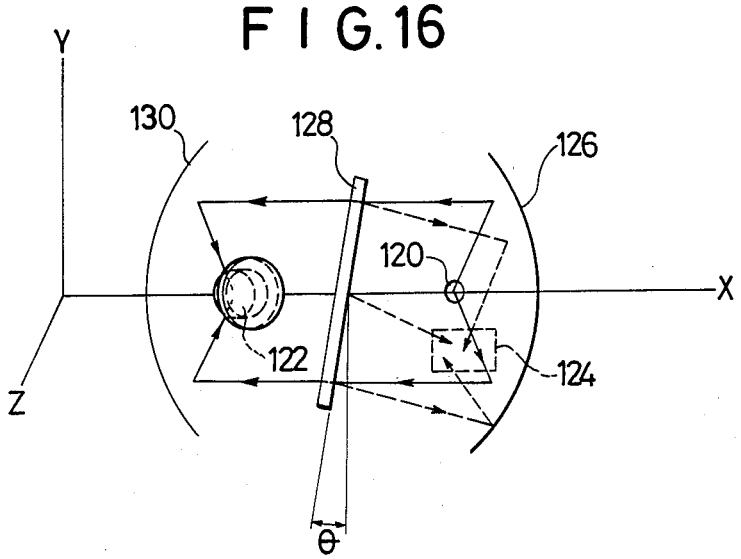
FIG. 16 is a bottom view thereof.
Figure 17:
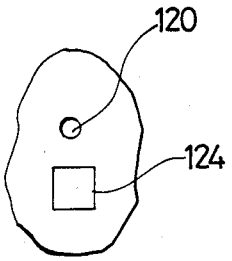
FIG. 17 is a sectional view taken on line A—A'.

At this time the sensors provide such waveforms of electric signal outputs as shown in FIGS. 13-A, B and C, of which FIG. 13-A shows such waveforms obtained by arranging the infrared ray sensor 102 and the visible ray sensor 104 according to the first example of sensors. By way of comparison, in FIG. 13-B the infrared ray sensor 102 and the visible ray sensor 104 are disposed each independently in parallel and the moving direction of reflected light and the sensor arrangement direction are perpendicular to each other; likewise, in FIG. 13-C both sensors are disposed each independently in parallel and the moving direction of reflected light and the sensor arrangement direction are the same.

More specifically, according to the sensor arrangement in the first example, the output signal waveform of the infrared ray sensor 102 is trapezoid a and that of the visible ray sensor 104 is also a trapezoidal waveform b which is almost the same as the output signal waveform of the infrared ray sensor. Where the sensor arrangement is as shown in FIG. 13-B, output signals from the infrared ray sensor 102 and visible ray sensor 104 are of trapezoidal waveforms a and b rising and disappearing simultaneously. Further, where the sensor arrangement is as shown in FIG. 13-C, an output signal from the visible ray sensor 104 is of a waveform b lagging and shifting in phase relative to the output signal waveform a of the infrared ray sensor. If these output signal waveforms are processed by a phase discriminator, there appears a phase difference waveform c in the case where the sensor arrangement relative to incident light is as shown in FIG. 13-C.

Where selective amplifier circuits are used as the output amplifiers for sensor signals, their output signals and phase difference detection signal have waveforms similar to differential waveforms a', b' and c' shown in FIGS. 13-A, B and C.

Thus, where the reflected light from the sun is incident on the sensors under vibration, and in some particular relation between the arrangement of both sensors and the incident light moving direction, there appears a phase difference between the output signals from both sensors and the result is as if there were detected a flame flaring, thus causing an erroneous detection. But in the arrangement of the infrared ray sensor and the visible ray sensor according to the first example, there will never occur a phase difference between the output signals from both sensors no matter from which direction light may be incident, so there is no fear of an erroneous detection.

In the above first example two kinds of sensors are disposed concentrically and light is incident on both sensors simultaneously, while in the following second example an incident light is divided in two by an optical system and then incident on two sensors simultaneously.

According to a second example of sensors, which is shown in FIGS. 14 to 17, an infrared band pass filter and a paraboloidal mirror are used, and an infrared ray sensor and a visible ray sensor are disposed in optically conjugate positions, namely, in optically equivalent imaging positions relative to incident light, thereby allowing light to be incident on both sensors simultaneously.

More specifically, in FIGS. 14 to 17, the reference numerals 126 and 130 denote paraboloidal mirrors which are disposed so that paraboloids thereof face to each other and optical axes thereof are aligned. Numeral 128 denotes an infrared band pass filter which allows an infrared ray of wavelength 4.3 $\mu$m to pass therethrough but acts as a reflector against visible rays. This filter is inclined by an angle of $\theta$ relative to a plane perpendicular to the optical axes of both paraboloidal mirrors. Numeral 120 denotes a light incidence window located in a focal position of the paraboloidal mirror 126. Numeral 124 denotes a visible ray sensor disposed in a position where the light reflected from the surface of the infrared band pass filter 128 is again reflected by the paraboloidal mirror 126 and converged. This position of the visible ray sensor 124 is close to the light incidence window 120 and deviates in the direction of the Y axis relative to the light incidence window 120.

An optical path of an infrared ray will first be explained. Infrared rays incident on the light incidence window 120 through the detection field are reflected by the paraboloidal mirror 126 and become approximately parallel rays relative to the X axis. Then, the parallel infrared rays are incident on the band pass filter 128, through which only an infrared ray of wavelength 4.3 $\mu$m passes, then the transmitted infrared ray is converged by the paraboloidal mirror 130 and incident on the infrared ray sensor 122.

An optical path of visible rays will now be explained. Visible rays incident on the infrared band pass filter 128 through the same optical path as that of the infrared rays are reflected by the surface of the filter 128, then reflected again by the paraboloidal mirror 126 and converged near the incidence window 120 and incident on the visible ray sensor 124 disposed there.

The reason why the infrared band pass filter 128 is inclined by the angle $\theta$ relative to the plane perpendicular to the optical axes of both paraboloidal mirrors is as follows. The visible rays reflected from the filter 128 are reflected again by the paraboloidal mirror 126 and converged near the incidence window 120. But if the filter 128 is not inclined, the visible rays will be converged on the incidence window 120 and since the visible ray sensor cannot be disposed there, the infrared band pass filter 128 is inclined so that the visible rays are converged in a position close to the incidence window 120 and deviated in the Y-axis direction.

The reflection surfaces of the paraboloidal mirrors 126 and 130 are metallic mirror surfaces formed of gold, aluminum or any other suitable metal and having a high reflectance against infrared and visible rays.

The incidence window 120 is larger than the infrared ray sensor 122 and it is made of a material which transmits infrared and visible rays, e.g. $SiO_2$, $CaF_2$ or $Al_2O_3$ and so on.

The visible ray sensor 124 has a size larger than that of the infrared ray sensor 122 because width of incident light bundles expand due to the off-axial aberrations of the paraboloidal mirror 126. For example, if the paraboloidal mirrors 126 and 130 have a focal distance of 20 mm and $\theta=9°$, visible rays are converged in a position about 6 mm away from the incidence window 120 and the converged light beam becomes about 6 mm in diameter relative to the incidence window of 2 mm in diameter.

When there are used paraboloidal mirrors having a focal distance of 20 mm and an infrared band pass filter having a diameter of 25 mm, there is obtained a wide angle, about 80°, of a detection field. Since paraboloidal mirrors 126 and 130 are used as reflectors, light rays are incident on the infrared band pass filter 128 approximately perpendicularly and therefore an aberration does not occur over a wide angular range of incident light rays, nor is there a bias in the sensitivity distribution. Thus it is not necessary to consider the change in characteristics of the filter which causes a problem in the case of an oblique incident light.

Further, since the incidence window can be formed small, the window material is minimized; the infrared band pass filter also serves as a beam splitter; and the paraboloidal mirror serves as both a collimator lens and a condenser lens, therefore it is possible to reduce the number of parts required.

Figure 18:
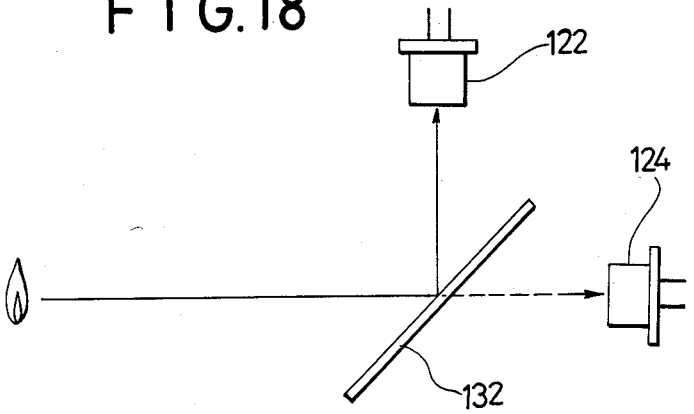
FIG. 18 is a front view of a third example of sensors used in the invention.

Referring now to FIG. 18, there is shown a third example of sensors, in which a half mirror is used in an incident light dividing optical system whereby, out of incident light rays, infrared rays are reflected by the surface of a half mirror 132 and incident on an infrared ray sensor 122, while visible rays passes through the half mirror 132 and is incident on a visible ray sensor 124.

Figure 19:
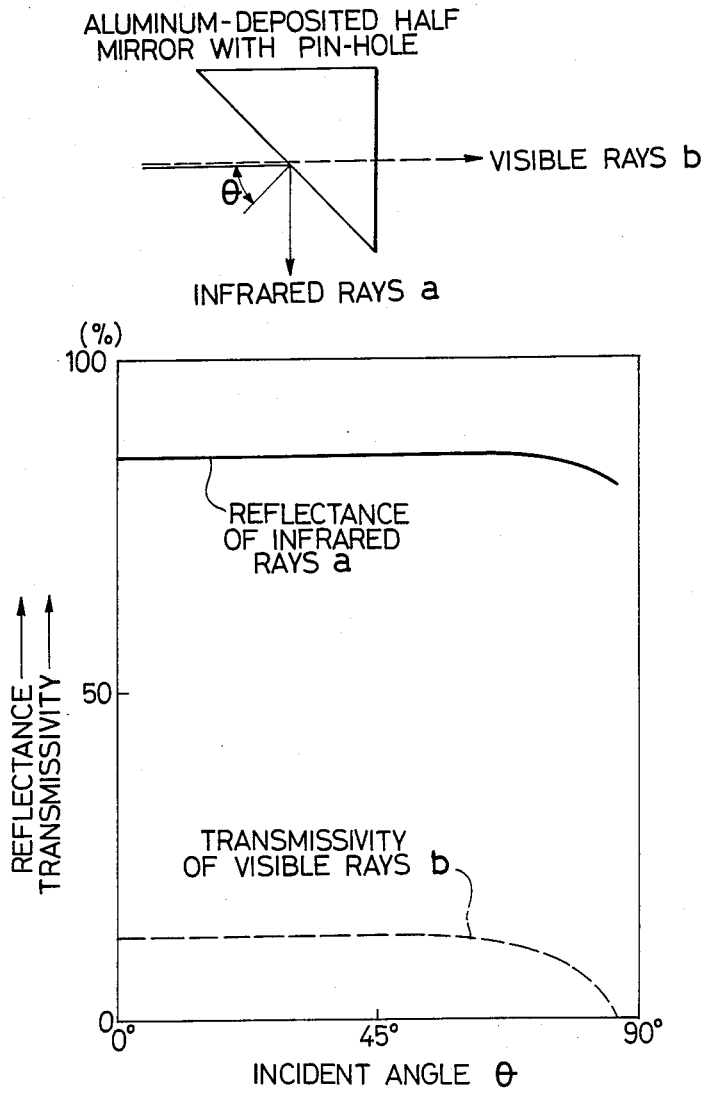
FIG. 19 is a reflectance-transmittance characteristic diagram of an aluminum-deposited half mirror with pin-hole.
Figure 20:
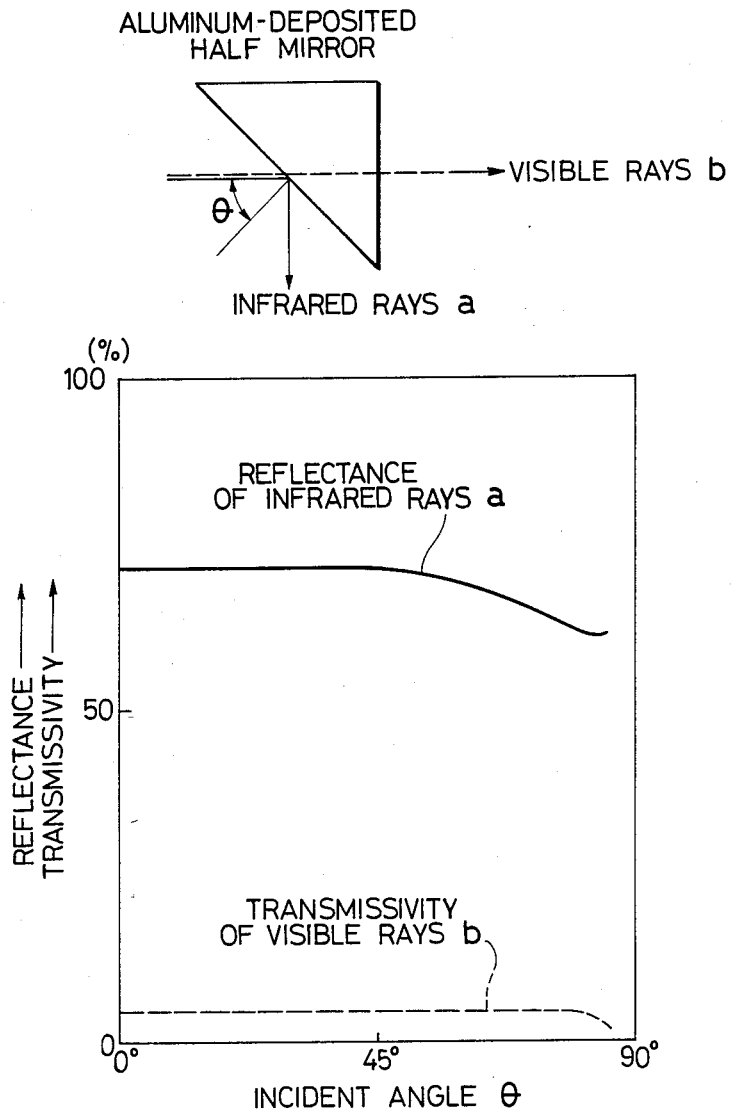
FIG. 20 is a reflectance-transmittance characteristic diagram of an aluminum-deposited half mirror.
Figure 21:
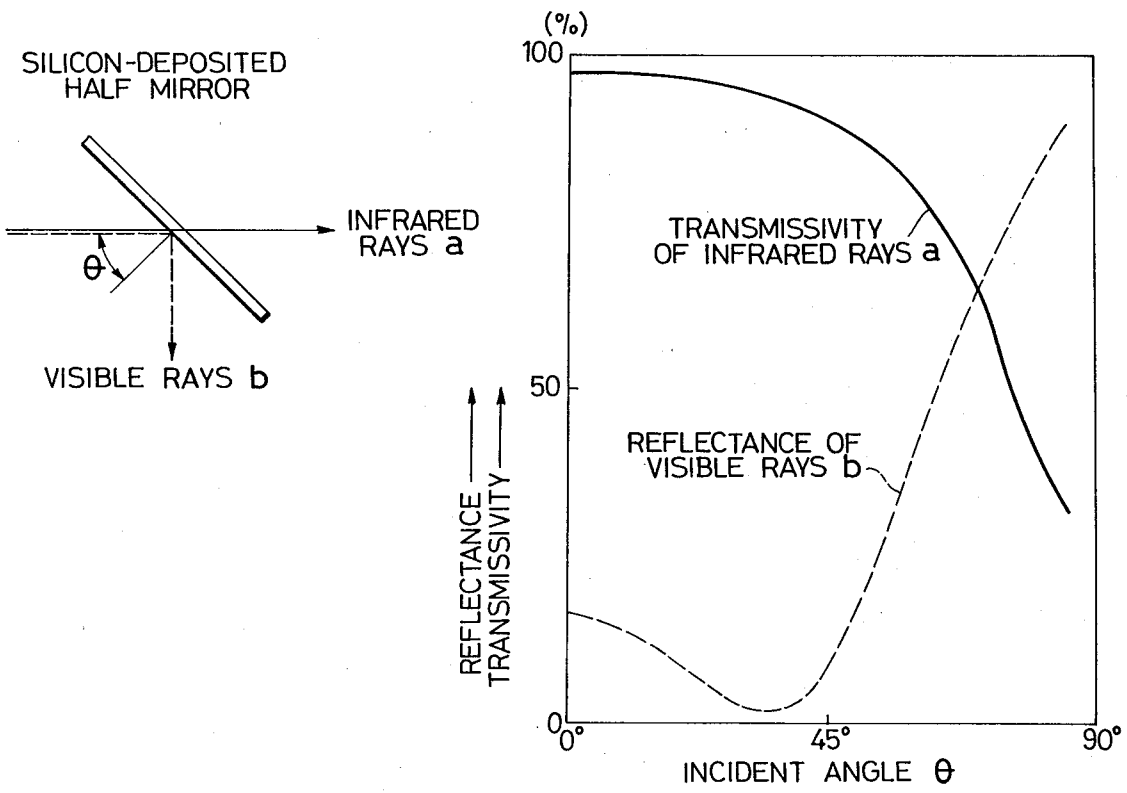
FIG. 21 is a reflectance-transmittance characteristic diagram of a half mirror with silicon thin film.

As the half mirror there may be used (1) an aluminum-deposited half mirror with pin-hole, (2) an aluminum-deposited half mirror or (3) a silicon-deposited half mirror. Reflection and transmission characteristics of the half mirror are as shown in FIGS. 19 to 21. More particularly, FIG. 19 shows reflectance and transmissivity of infrared and visible rays relative to an incident angle $\theta$ in the case of a prism having a pin-hole to aluminum-deposited surface area ratio of 1:9. FIG. 20 shows reflectance and transmissivity of infrared and visible rays relative to an incident angle $\theta$ in the case of a prism having a thin aluminum film about 250 Å in thickness. In these two examples, characteristics of the half mirror can be changed freely by adjusting the area of pin hole and the thickness of the aluminum-deposited film. In the case of using a plate-like half mirror in place of a prism, the visible ray transmissivity deteriorates to a large extent as the angle of incidence $\theta$ approaches 90°. FIG. 21 shows reflectance and transmissivity of infrared and visible rays relative to the angle of incidence $\theta$ in the case of a half mirror which is provided with a thin silicon film on a plate for the purpose of improving the infrared ray transmitting characteristic. In this case, infrared rays are transmitted and visible rays reflected.

Thus the use of a half mirror is suitable for a narrow incident angle range because the reflectance and transmissivity vary depending on the angle of incidence of incident light. Further, where there is an afocal light bundle in the optical system for detection, it is desirable to use a half mirror in that afocal light bundle.

Figure 22:
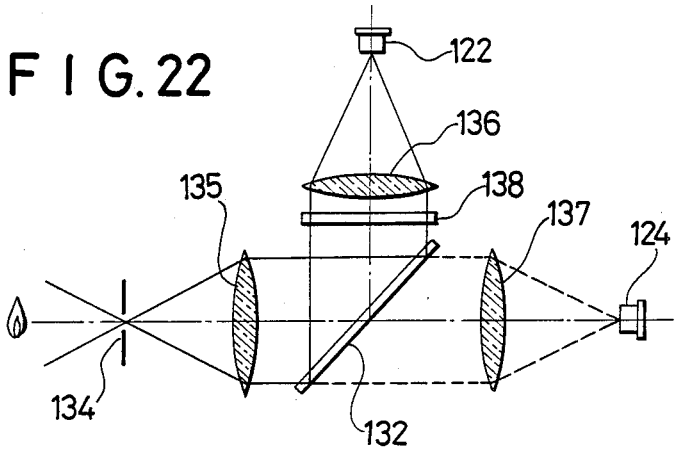
FIG. 22 is a side view of a fourth example of sensors used in the invention.

Referring now to FIG. 22, there is shown a fourth example of sensors, in which in the optical system using a half mirror described in the above third example, an infrared band pass filter 138 for the wavelength of 4.3 $\mu$m is disposed between the half mirror 132 and a condenser lens 136 located in front of the infrared ray sensor 122, whereby infrared rays reflected from the half mirror 132 are directed to the infrared band pass filter 138 and an infrared ray of a wavelength (4.3 $\mu$m) peculiar to flame is detected selectively. In the figure, numeral 134 denotes an incident window; numeral 135 denotes a collimator lens; numerals 136 and 137 denote condenser lenses; and numeral 124 denotes a visible ray sensor.

Figure 23:
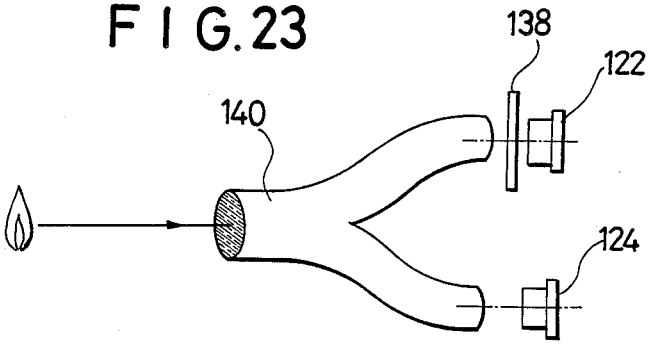
FIG. 23 is a side view of a fifth example of sensors used in the invention.

Referring now to FIG. 23, there is shown a fifth example of sensors, using an optical fiber bundle 140, which bundle is in the form of a single bundle at a light incident end and is divided in two at an opposite end. One branch end is disposed toward an infrared ray sensor 122 through a 4.3 $\mu$m infrared band pass filter 138, while the other branch end is disposed toward a visible ray sensor 124. The optical fiber bundle is made of a material which transmits visible and infrared rays, e.g. $GeO_2$.

Light is incident from the incident end as a single optical fiber bundle 140 and is divided in two while passing through the optical fiber bundle. One branch light is incident on the infrared ray sensor 122 through the infrared band pass filter 138, while the other branch light is incident on the visible ray sensor 124. Infrared ray of a wavelength (4.3 $\mu$m) peculiar to flame can be detected selectively.

Figure 24:
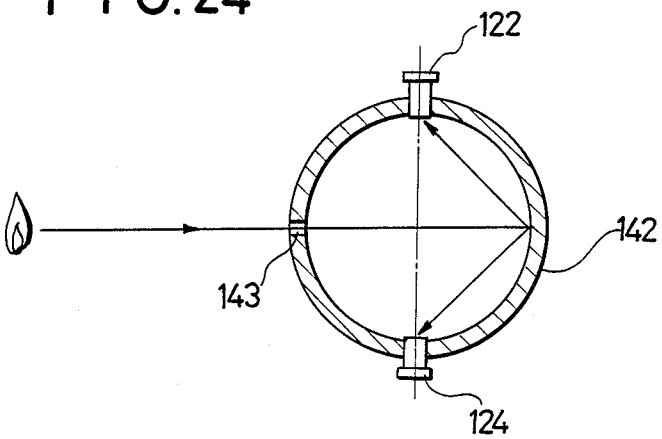
FIG. 24 is a sectional side view of a sixth example of sensors used in the invention.

Referring now to FIG. 24, there is shown a sixth example of sensors using an integrating sphere, in which an integrating sphere 142 is provided with an incidence window 143, and an infrared ray sensor 122 and a visible ray sensor 124 are disposed toward an inner surface of the integrating sphere. Light from the incidence window 143 is integrated by the integrating sphere 142 and incident on both sensors 122 and 124 simultaneously.

Figure 25:
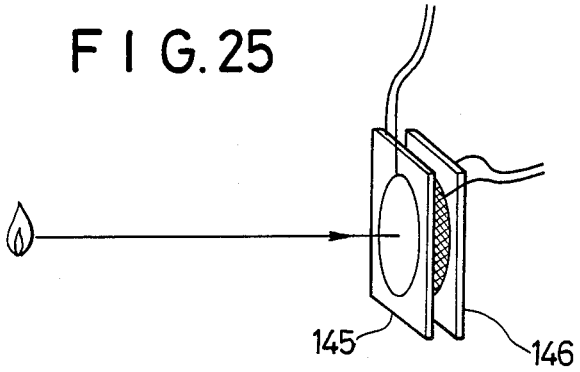
FIG. 25 is a perspective view of a seventh example of sensors used in the invention.

Referring now to FIG. 25, there is shown a seventh example of sensors, in which incident light is optically divided and detected by utilizing the spectrosensitivity and transmissivity characteristics of a silicon photosemiconductor.

Figure 26:
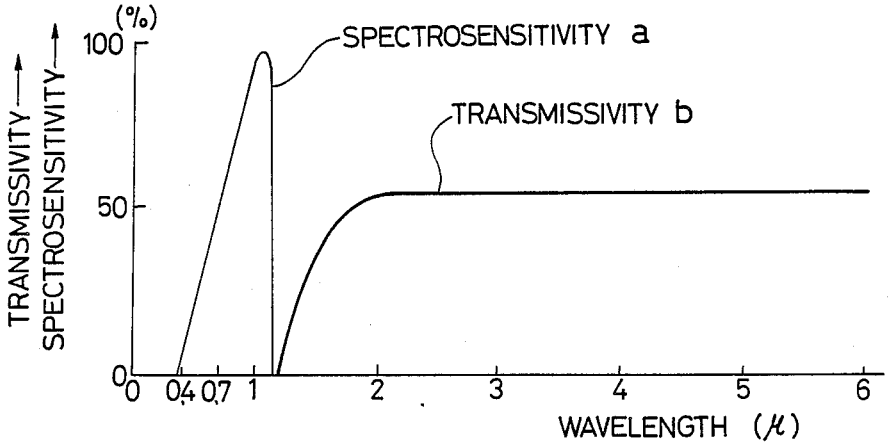
FIG. 26 is a spectral characteristic diagram of a silicon photosemiconductor used in the sensors of FIG. 25.

Some silicon photosemiconductor exhibits a sharp spectrosensitivity to visible light rays of wavelength 1 $\mu$m and thereabouts as indicated by line "a" in FIG. 26 and the light transmissivity thereof is high for light rays of 2 $\mu$m and larger in wavelength as indicated by line "b" in the same figure.

It is the seventh example shown in FIG. 25 that utilizes the above characteristics. In FIG. 25, numeral 145 denotes a visible ray sensor which transmits light rays of 2 $\mu$m and larger in wavelength, the visible ray sensor 145 being constituted by a silicon photosemiconductor, and numeral 146 denotes an infrared ray sensor (a pyroelectric element such as thermopile or PbS) disposed behind and adjacent the visible ray sensor 145.

Light to be detected is incident on the visible ray sensor 145 and an output signal is taken out from the same sensor when visible rays are present, and light to be detected in the infrared wavelength range not smaller than 2 $\mu$m pass through the visible ray sensor 145 and are incident on the infrared ray sensor 146 disposed therebehind, from which an output signal is taken out.

According to the sensors used in the above examples, as set forth above, there does not occur any time lag at the time of incidence of light upon both sensors, so even when a beam-like interfering light such as a reflected light of the sunlight flares and is incident in this state upon the sensors, there does not occur a phase shift in the electric output signals from both sensors, thus eliminating the fear of an erroneous detection.

In the above described embodiments, detection of flames are carried out by the detection of an infrared ray of 4.3 $\mu$m or thereabout in wavelength and visible ray.

However, this invention is not limited to the detection of light of the wavelength described in the embodiments, but the light to be detected may be used for any light in a wavelength range in which the radiation energy of a flame is relatively large while the radiation energy of the sun is relatively small and any light in a wavelength range in which the radiation energy of the flame is relatively small while the radiation energy of the sun is relatively large.

Although the present invention has been fully described by way of example with reference to the accompanying drawings, it is to be noted here that various changes and modifications will be apparent to those skilled in the art. Therefore, unless otherwise such changes and modifications depart from the scope of the present invention, they should be construed as being included therein.

What is claimed is:

1. A flame detector comprising;

first means for receiving light from an area to be detected to produce a first light receiving signal indicating intensity of the received light in a first wavelength range in which radiation energy of a flame is relatively large while the radiation energy of the sun is relatively small;

second means for receiving light from the area to produce a second light receiving signal indicating intensity of the received light in a second wavelength range in which radiation energy of a flame is relatively small while the radiation energy of the sun is relatively large;

first means for integrating the first light receiving signal to produce a first integrating signal indicating the integrated result;

first means for comparing the first light receiving signal with the second light receiving signal to produce a first comparing signal relating to the difference of phase between the first light receiving signal and the second light receiving signal;

second means for integrating, in accordance with the first comparing signal, a portion of the first light receiving signal which portion is different in phase from the second light receiving signal, to produce a second integrating signal;

second means for comparing the first integrating signal with the second integrating signal to produce a second comparing signal indicating the compared result; and means for detecting the occurrence of flame in accordance with the second comparing signal.

2. A flame detector according to claim 1, wherein said detecting means includes a third means for comparing the second integrating signal with a predetermined value to produce a third comparing signal indicating the compared result, and means for detecting the occurrence of flame in accordance with both of the second comparing signal and the third comparing signal.

3. A flame detector according to claim 1, wherein said detecting means includes a first means for detecting the occurrence of flame in accordance with only the first light receiving signal, and a second means for detecting the occurrence of flame in accordance with the second comparing signal when the occurrence of flame is detected by the first detecting means.

4. A flame detector according to claim 3, wherein said first detecting means includes means for comparing the first integrating signal with a predetermined valve to produce a detecting signal indicating the occurrence of flame when the amount integrated in the first integrating means exceeds the predetermined valve.

5. A flame detector according to claim 3, wherein said first detecting means includes means for detecting a frequency component peculiar to flames in the first light receiving signal to detect the occurrence of flame.

6. A flame detector according to claim 1, wherein said detecting means includes timer means for resetting the first and second integrating means at every predetermined time period, and means for detecting the occurrence of flame when the second comparing signal reaches a predetermined value.

7. A flame detector according to claim 1, wherein said detecting means includes means for detecting, in accordance with the first light receiving signal, flaring peculiar to flame to produce a flaring signal at every flaring detection, means for counting the number of the flaring signals to produce a counting signal indicating the counted result, means for controlling the operation of said first and second integrating means and said counting means, said controlling means starting its operation in accordance with the flaring signal, and means for judging whether the flame is occurred or not in accordance with the second comparing signal and the counting signal.

8. A flame detector according to claim 7, wherein said judging means includes means for judging whether the flame is occurred or not in accordance with the second comparing signal and the counting signal, means for outputting an alarm signal indicating the occurrence of flame when said judging means judges the occurrence of flame, and means for resetting the controlling means when said judging means judges no occurrence of flame.

9. A flame detector according to claim 1, wherein said detecting means includes means for detecting, in accordance with the first light receiving signal, flaring peculiar to flame to produce a flaring signal at every flaring detection, means for counting the number of the flaring signals to produce a counting signal indicating the counted result, means for controlling the operation of said first and second integrating means and said counting means, said controlling means starting its operation in accordance with the flaring signal, and means for resetting the controlling means when a predetermined period of time has passed without the flaring signal.

10. A flame detector according to claim 1, wherein said second light receiving means is disposed in annular form along the circumference of said first light receiving means.

11. A flame detector according to claim 10, further comprising means, located in front of said second light receiving means, for diffusing light which will be incident on said second light receiving means.

12. A flame detector according to claim 1, further comprising means for dividing incident light into a portion directed to said first light receiving means and the other portion directed to said second light receiving means.

13. A flame detector according to claim 12, wherein said incident light dividing means includes a pair of paraboloidal mirrors each having a light reflecting surface of paraboloidal shape, said pair of paraboloidal mirrors being faced to each other and having an identical optical axis, a band pass filter, which permits transmission of light in the first wavelength range and reflects light in the second wavelength range, being disposed between the pair of paraboloidal mirrors inclinedly with respect to a plane perpendicular to the identical optical axis, and an incident window, which permits the incidence of light on the pair of paraboloidal mirrors, being disposed on a focal position of one of the paraboloidal mirrors, and wherein said first light receiving means is arranged in a position where light reflected on the band pass filter is converged after reflection of one of the paraboloidal mirrors while said second light receiving means is arranged in a focal position of the other paraboloidal mirrors.

14. A flame detector according to claim 12, wherein said incident light dividing means includes means for dividing the light by reflecting a portion of the incident light and by permitting the transmission of the other portion of the incident light.

15. A flame detector according to claim 14, wherein said light dividing means includes a half mirror for reflecting the light in one of the first and second wavelength ranges and for permitting the transmission of the light in the other of the first and second wavelength ranges.

16. A flame detector according to claim 12, wherein said incident light dividing means includes an optical fiber bundle having an incident end directed to incident light and two exit ends opposite to the incident end, each exit end being faced to the first and second light receiving means respectively.

17. A flame detector according to claim 12, wherein said incident light dividing means includes an integrating sphere having an incident window through which incident light is led into the integrating sphere, and wherein said first and second light receiving means are disposed in the integrating sphere to receive light integrated in the integrating sphere.

18. A flame detector accordng to claim 12, wherein said incident light dividing means and said first and second light receiving means includes a first light receiving element disposed for receiving incident light, said first light receiving element having a high transmissivity for light in the first wavelength range and a sensitivity to light in the second wavelength range, and a second light receiving element disposed for receiving light transmitted through the light receiving element.

19. A flame detector according to claim 18, wherein said first light receiving element is made of silicon photosemiconductor.

20. A flame detector comprising:

first means for receiving light from an area to be detected to produce a first light receiving signal indicating intensity of the received light in a first wavelength range in which the radiation energy of a flame is relatively large while the radiation energy of the sun is relatively small;

second means for receiving light from the same area to produce a second light receiving signal indicating intensity of the received light in a second wavelength range in which radiation energy of the flame is relatively small while the radiation energy of the sun is relatively large, said second light receiving means being disposed annularly along the circumference of said first light receiving means; and means for comparing the phase of the first light receiving signal with the phase of the second light receiving signal to detect the occurrence of flame on the basis of the existence of the second light receiving signal having a phase which is different from the phase of the first light receiving signal.

21. A flame detector according to claim 20, wherein the second light receiving means includes means, disposed annularly along the circumference of the first light receiving means, for diffusing light passed therethrough, and means for receiving the light passed through the diffusing means.

22. A flame detector comprising;

a pair of paraboloidal mirrors having an identical optical axis and respective focal positions that are different from each other, said mirrors being arranged symmetrically with each other with respect to a line perpendicular to the identical optical axis;

first means for receiving light from an area to be detected to produce a first light receiving signal indicating the intensity of the received light in a first wavelength range in which the radiation energy of the flame is relatively large while the radiation energy of the ambient light is relatively small, said first light receiving means being arranged in a focal position of one of the pair of paraboloidal mirrors;

a band pass filter which permits transmission of light in the first wavelength range and reflects light in a second wavelength range in which the radiation energy of the flame is releatively small while the radiation energy of the ambient light is relatively large, said band pass filter being disposed between the pair of paraboloidal mirrors in an inclined realtionship with respect to a plane perpendicular to the identical optical axis;

an incident window, which permits the incidence of light on the pair of paraboloidal mirrors, being disposed on a focal position of one of the paraboloidal mirrors;

second means for receiving light from the area to produce a second light receiving signal indicating intensity of the received light in the second wavelength range, said second light receiving means being arranged in a focal position of the other paraboloidal mirrors; and means for comparing the phase of the first light receiving signal with the phase of the second light receiving signal to detect the occurrence of flame on the basis of the existence in the second light receiving signal of a phase difference from the phase of the first light receiving signal.

23. A flame detector comprising;

first means for receiving light from an area to be detected to produce a first light receiving signal indicating intensity of the received light in a first wavelength range in which radiation energy of flame is relatively large while the radiation energy of the ambient light is relatively small;

second means for receiving light from the area to produce a second light receiving signal indicating intensity of the received light in a second wavelength range in which radiation energy of the flame is relatively small while the radiation energy of the ambient light is relatively large;

means for dividing light from the area into two portions one of which is directed to said first light receiving means and the other of which is directed to said second light receiving means; and means for comparing the phase of the first light receiving signal with the phase of the second light receiving signal to detect the occurrence of a flame on the basis of the existence in the second light receiving signal of a phase difference from the phase of the first light receiving signal.

24. A flame detector according to claim 23, wherein said light dividing means includes a half mirror for reflecting the light in one of the first and second wavelength ranges and for permitting the transmission of the light in the other of the first and second wavelength ranges.

25. A flame detector according to claim 23, wherein said light dividing means includes an optical fiber bundle having an incident end directed to incident light and two exit ends opposite to the incident end each exit end being faced to the first and second light receiving means respectively.

26. A flame detector according to claim 23, wherein said light dividing means includes an integrating sphere having an incident window through which incident light is led into the integrating sphere, and wherein said first and second light receiving means are disposed in the integrating sphere to receive light integrated in the integrating sphere.

27. A flame detector according to claim 23, wherein said light dividing means and said first and second light receiving means includes a first light receiving element disposed for receiving incident light, said first light receiving element having a high transmissivity for light in the first wavelength range and a sensitivity to light in the second wavelength range, and a second light receiving element disposed for receiving light transmitted through the first light receiving element.

28. A flame detector according to claim 27, wherein said first light receiving element is made of a silicon photosemiconductor.

29. A flame detector according to claim 23, wherein said light dividing means includes a pair of paraboloidal mirrors each having a light reflecting surface of a paraboloidal shape, said pair of paraboloidal mirrors being faced to each other and having an identical optical axis, a band pass filter, which permits transmission of light in the first wavelength range and reflects light in the second wavelength range, being disposed between the pair of paraboloidal mirrors inclinedly with respect to a plane perpendicular to the identical optical axis, and an incident window, which permits the incidence of light on the pair of paraboloidal mirrors, being disposed on a focal position of one of the paraboloidal mirrors, and wherein said first light receiving means is arranged in a position where light reflected on the band pass filter is converged after reflection of one of the paraboloidal mirrors while said second light receiving means is arranged in a focal position of the other paraboloidal mirrors.

* * * * *